United States Patent [19]

Maskasky

[11] Patent Number: 5,061,617

[45] Date of Patent: Oct. 29, 1991

[54] PROCESS FOR THE PREPARATION OF HIGH CHLORIDE TABULAR GRAIN EMULSIONS

[75] Inventor: Joe E. Maskasky, Rochester, N.Y.

[73] Assignee: Eastman Kodak Company, Rochester, N.Y.

[21] Appl. No.: 623,839

[22] Filed: Dec. 7, 1990

[51] Int. Cl.[5] ..... G03C 1/035

[52] U.S. Cl. ..... 430/569; 430/567

[58] Field of Search ..... 430/567, 569

[56] References Cited

U.S. PATENT DOCUMENTS

| | | | |
|---|---|---|---|
| 2,222,264 | 11/1940 | Nietz et al. | 430/603 |
| 4,399,215 | 8/1983 | Wey | 430/567 |
| 4,400,463 | 8/1983 | Maskasky | 430/434 |
| 4,414,306 | 11/1983 | Wey et al. | 430/434 |
| 4,439,520 | 3/1984 | Kofron et al. | 430/434 |
| 4,713,323 | 12/1987 | Maskasky | 430/569 |
| 4,783,398 | 11/1988 | Takada et al. | 430/567 |
| 4,804,621 | 2/1989 | Tufano et al. | 430/567 |
| 4,942,120 | 7/1990 | King et al. | 430/567 |
| 4,952,491 | 8/1990 | Nishikawa | 430/570 |

OTHER PUBLICATIONS

Endo & Okaji *J. Photographic Science,* vol. 36, pp. 182–189, "An Empirical Rule to Modify the Crystal Habit of Silver Chloride to Form Tabular Grains in an Emulsion".

*Primary Examiner*—Charles L. Bowers, Jr.
*Assistant Examiner*—Janet C. Baxter
*Attorney, Agent, or Firm*—Carl O. Thomas

[57] ABSTRACT

An improved process is disclosed of preparing a high chloride tabular grain emulsion. The concentration of thiocyanate ion in the dispersing medium at nucleation and during grain growth is relied upon a favor the formation of {111} crystal faces. The concentration of chloride ion in the thiocyanate ion containing dispersing medium is relied upon to produce the grain twinning necessary for tabular grain formation.

17 Claims, 2 Drawing Sheets

1μm

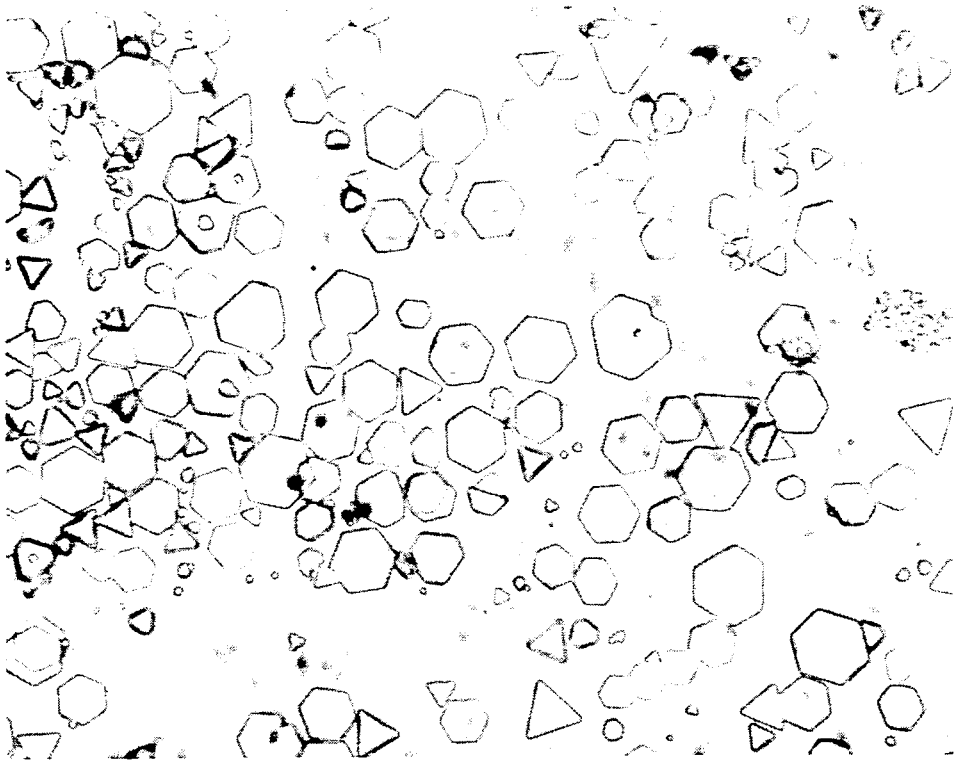
FIG. 2 10 μm
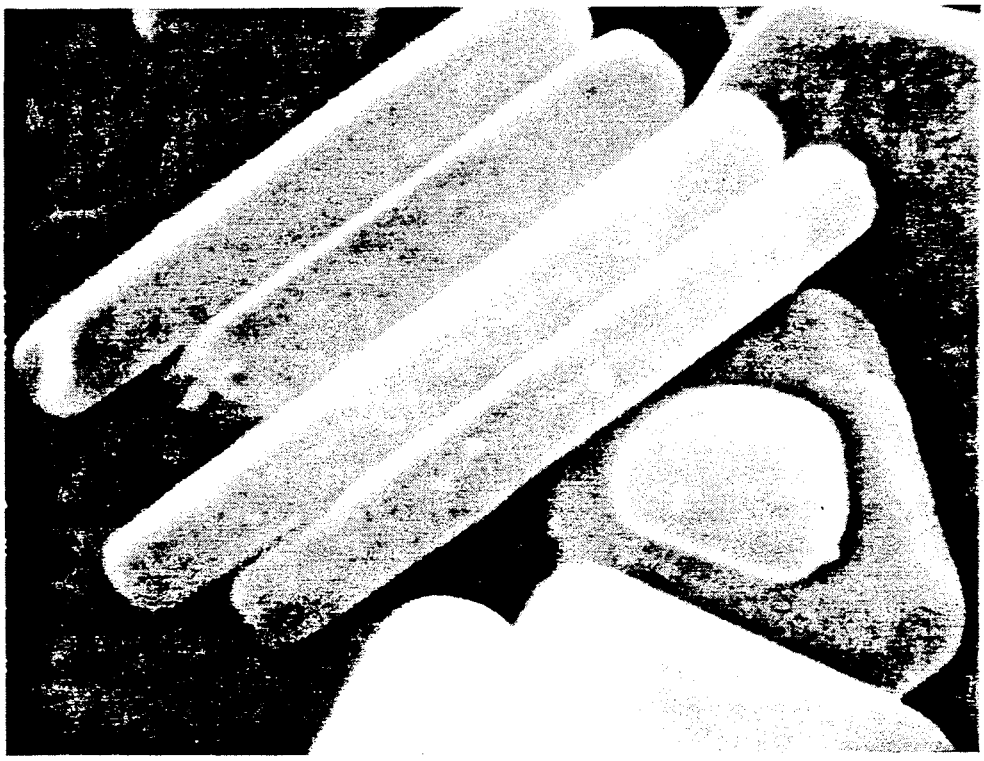
FIG. 3 0.5 μm

PROCESS FOR THE PREPARATION OF HIGH CHLORIDE TABULAR GRAIN EMULSIONS

FIELD OF THE INVENTION

The invention relates to an improved process for the preparation of photographic emulsions containing radiation sensitive tabular grains. More specifically, the invention relates to an improved process for the preparation of high chloride tabular grain emulsions.

BACKGROUND OF THE INVENTION

Radiation sensitive silver halide emulsions containing one or a combination of chloride, bromide and iodide ions have been long recognized to be useful in photography. Each halide ion selection is known to impart particular photographic advantages. Although known and used for many years for selected photographic applications, the more rapid developability and the ecological advantages of high chloride emulsions have provided an impetus for employing these emulsions over a broader range of photographic applications. As employed herein the term "high chloride emulsion" refers to a silver halide emulsion containing at least 50 mole percent chloride and less than 5 mole percent iodide, based on total silver.

During the 1980's a marked advance took place in silver halide photography based on the discovery that a wide range of photographic advantages, such as improved speed granularity relationships, increased covering power both on an absolute basis and as a function of binder hardening, more rapid developability, increased thermal stability, increased separation of blue and minus blue imaging speeds, and improved image sharpness in both mono and multi emulsion layer formats, can be realized by increasing the proportions of selected tabular grain populations in photographic emulsions.

In general the greater the proportion of the total grain population accounted for by tabular grains, the greater the advantages realized. This parameter is typically specified in terms of the percentage of the total grain projected area accounted for by the selected tabular grain population.

The property of the selected tabular grain population which sets it apart from the remaining grains, if any, in the emulsion and predicts its advantages in relation to other selected tabular grain populations is herein referred to as "tabularity", where the mean tabularity of a selected tabular grain population is determined from the relationship:

$$D/t^2$$

where

D is the effective circular diameter (ECD) in $\mu$m of the tabular grains and t is the thickness in $\mu$m of the tabular grains.

Although the art has succeeded in preparing high chloride tabular grain emulsions, the inclusion of high levels of chloride as opposed to bromide, alone or in combination with iodide, has been difficult. The basic reason is that tabular grains are produced by incorporating parallel twin planes in grains grown under conditions favoring {111} crystal faces. The most prominent feature of tabular grains are their parallel {111} major crystal faces.

To produce successfully a high chloride tabular grain emulsion two obstacles must be overcome. First, the strong propensity of silver chloride to produce {100} crystal faces must be overcome by finding conditions that favor the formation of {111} crystal faces. Second, conditions must be found that incorporate parallel twin planes in the grains.

Wey U.S. Pat. No. 4,399,215 produced the first high aspect ratio ($D/t>8$) silver chloride emulsion. An ammoniacal double Jet precipitation technique was employed. The tabularity of the emulsions was not high compared to contemporaneous silver bromide and bromoiodide tabular grain emulsions because the ammonia thickened the tabular grains. A further disadvantage was that significant reductions in tabularity occurred when bromide and/or iodide ions were included in the tabular grains.

Wey et al U.S. Pat. No. 4,414,306 developed a process for preparing silver chlorobromide emulsions containing up to 40 mole percent chloride based on total silver. This process of preparation has not been successfully extended to high chloride emulsions.

Maskasky U.S. Pat. No. 4,400,463 developed a strategy for preparing a high chloride, high aspect ratio tabular grain emulsion capable of tolerating significant inclusions of the other halides. The strategy was to use a particularly selected synthetic polymeric peptizer in combination with a grain growth modifier having as its function to promote the formation of {111} crystal faces. Adsorbed aminoazaindenes and iodide ions were disclosed to be useful grain growth modifiers. This work has stimulated further investigations of grain growth modifiers for preparing tabular grain high chloride emulsions, as illustrated by Takada et al U.S. Pat. No. 4,783,398, which employs heterocycles containing a divalent sulfur ring atom; Tufano et al U.S. Pat. No. 4,804,621, which employs amino substituted diazines; and Nishikawa et al U.S. Pat. No. 4,952,491, which employs spectral sensitizing dyes during nucleation and divalent sulfur atom containing heterocycles and acyclic compounds during grain growth.

Maskasky U.S. Pat. No. 4,713,323, continuing to use an aminoazaindene growth modifier, discovered that tabular grain high chloride emulsions could be prepared by running silver salt into a dispersing medium containing at least a 0.5 molar concentration of chloride ion and an oxidized gelatino peptizer. An oxidized gelatino peptizer is a gelatino peptizer treated with a strong oxidizing agent to modify by oxidation (and eliminate or reduce as such) the methionine content of the peptizer. Maskasky taught to reduce the methionine content of the peptizer to a level of less than 30 micromoles per gram. King et al U.S. Pat. No. 4,942,120 is essentially cumulative, differing only in that methionine was modified by alkylation.

The discoveries that (1) strongly adsorbed grain growth modifiers can be used to achieve {111} crystal faces during the precipitation of high chloride emulsions and (2) chloride ion concentrations above 0.5M can be used to induce twin planes in the high chloride grains have provided the capability of preparing high chloride tabular grain emulsions. There has remained, however, the problem that the strongly adsorbed grain growth modifiers not only occupy grain surface sites as the grains are being formed, but also remain after grain formation. This places the adsorbed grain growth modifiers in competition with a wide variety of conventional emulsion addenda (such as chemical and spectral sensitizers, antifoggants and stabilizers, nucleating agents, etc.) that require grain adsorption to be effective.

This has led those skilled in the art to search for alternative choices in grain growth modifiers. K. Endo and M. Okaji, "An Empirical Rule to Modify the Crystal Habit of Silver Chloride to Form Tabular Grains in an Emulsion", J. Photographic Science, 1988, Vol. 36, (1988), pp. 182–189, set out to produce an empirical rule for selecting materials for use as grain growth modifiers in preparing silver chloride tabular grain emulsions by double-jet precipitation. The rule was tested by adding various ligands, $CN^-$, $SCN^-$, $I^-$, $(S_2O_3)^{-2}$, $(SO_3)^{-3}$ and thiourea (including derivatives) to 3M sodium chloride solutions at concentrations of 0.001, 0.005, 0.01 and 0.1M. The 3M sodium chloride solution was then used with 2M silver nitrate in double jet precipitations. Tabular grains having {100} and {111} faces were produced. Based on these investigations Endo et al concluded that to be useful as a grain growth modifier in forming tabular grain high chloride emulsions the first formation constant of the ligand, $\beta_1(L)$, must be more than $\beta_2(Cl^-)$—i.e., $\beta_2(Cl^-)/\beta_1(L)$ must be less than unity (one). In Table 2 Endo et al reported $\beta_2(Cl^-)/\beta_1(L)$ for $SCN^-$ to be 6.3, thereby indicating $SCN^-$ not to be suitable for use as a grain growth modifier. In FIG. 7 Endo et al shows a silver chloride grain population produced using 0.10M KSCN. The grains are relatively thick and are bounded by {100} top and bottom crystal faces, as is evident from the observed right angle crystal face intersections.

Although Endo et al rejected $SCN^-$ as a useful grain growth modifier in forming tabular grain high chloride emulsions, considering the known compatibility of thiocyanate ion with high levels of photographic performance it is not surprising that thiocyanate ions were among the candidates considered. Alkali metal and ammonium thiocyanates have been used for many years in silver halide photography as ripening agents both during and following the grain precipitation step. Nietz and Russell U.S. Pat. No. 2,222,264 report the single jet precipitation of silver chloride in the presence of thiocyanate. Kofron et al U.S. Pat. No. 4,439,520 taught the use of thiocyanate as a ripening agent in the preparation of high aspect ratio tabular grain emulsions and also in their sensitization.

SUMMARY OF THE INVENTION

It is an object of this invention to Provide a process for preparing high chloride tabular grain emulsions offering the advantages of high levels of tabularity while at the same time providing tabular grains efficiently compatible with photographic sensitizers and other adsorbed photographic addenda.

It is another object of this invention to provide a process for the preparation of high chloride tabular grain emulsions that can utilize a broad range of photographic peptizers, particularly gelatino peptizers either with or without prior oxidizing agent treatment.

The objects of this invention were realized by controverting the teaching of Endo et al that thiocyanate ions are not useful for obtaining emulsions comprised of high chloride tabular grains with {111} major crystal faces. Whereas Endo et al investigated only thiocyanate ion concentrations in the chloride salt solution introduced during double jet precipitations, the present invention was achieved by instead investigating ranges of thiocyanate ion concentrations in the reaction vessel. Specifically, the invention was realized by the discovery of a range of thiocyanate concentrations for each of grain nucleation and grain growth capable of facilitating the formation of high chloride tabular grain emulsions exhibiting high levels of tabularity.

In one aspect, this invention is directed to an improvement in a process of preparing a photographic emulsion comprised of a dispersing medium and radiation sensitive silver halide grains wherein at least 35 percent of the total grain projected area is accounted for by tabular grains having parallel {111} major crystal faces and containing at least 50 mole percent chloride, based on total silver, said emulsion being prepared by introducing silver ion into a dispersing medium containing chloride ion.

The improved process is characterized in that (i) grain nucleation is controlled to favor the formation of {111} crystal faces by providing thiocyanate ions in a concentration range of from 2 to 30 millimoles per liter in the dispersing medium prior to introducing silver ion, (ii) parallel twin planes are introduced in the grains by maintaining in the presence of thiocyanate ions a chloride ion concentration of at least 0.5 molar in the dispersing medium, and (iii) grain growth is controlled to favor the formation of the tabular grains having parallel {111} major crystal faces by maintaining a concentration of thiocyanate ions in the dispersing medium in the range of from 0.2 to 10 mole percent, based on total silver introduced.

BRIEF DESCRIPTION OF THE DRAWINGS

The invention can be better appreciated by reference to the following detailed description considered in conjunction with the drawings, in which

FIG. 2 is an optical photomicrograph of representative grains of a high chloride tabular grain emulsion produced by the process of the invention; and FIG. 3 is a scanning electron photomicrographic edge view of representative tabular grains of a high chloride tabular grain emulsion produced by the process of the invention.

DESCRIPTION OF PREFERRED EMBODIMENTS

Figure 1:
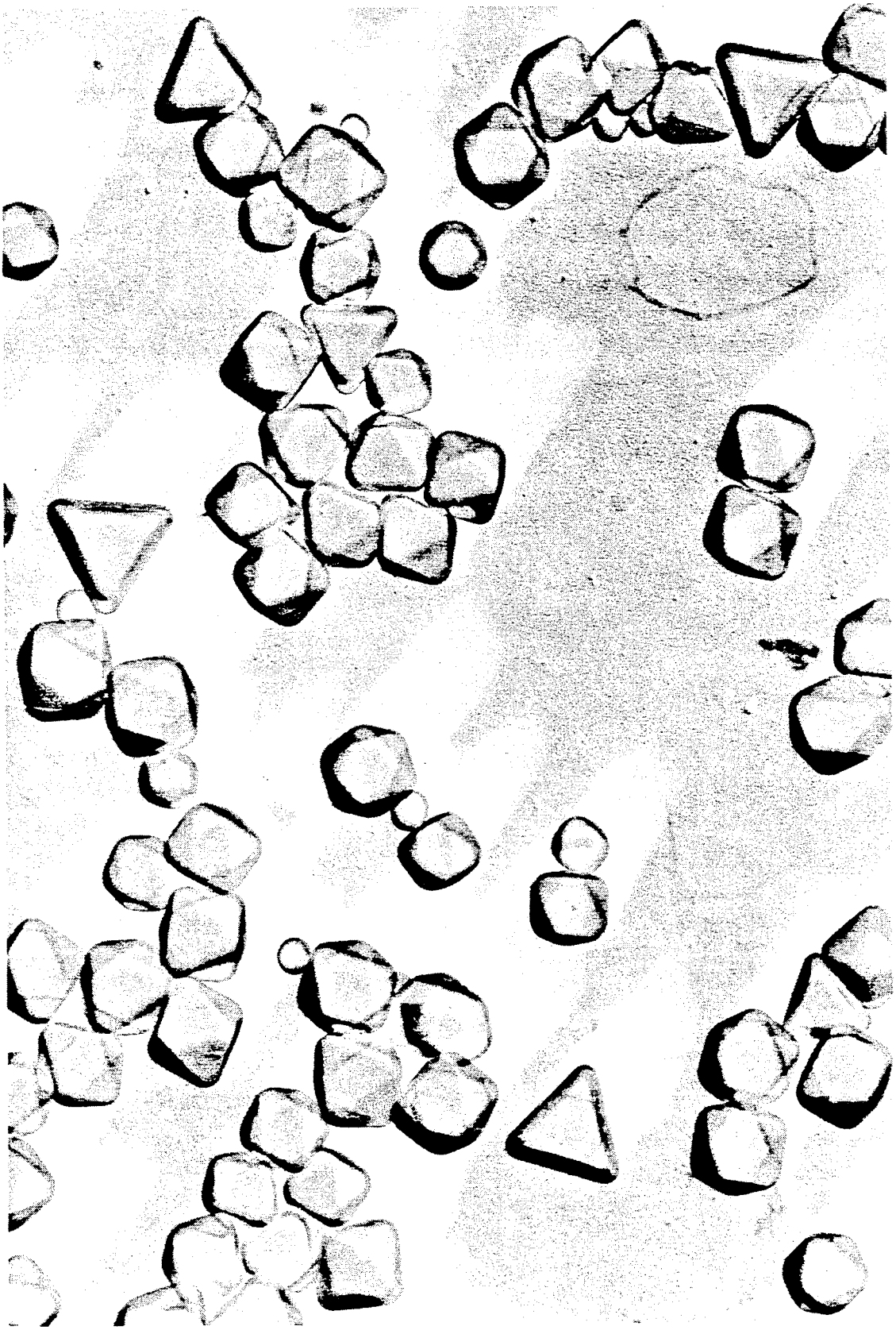
FIG. 1 is a carbon replica electron photomicrograph of representative grains of an high chloride octahedral emulsion.

An improved process for the preparation of high chloride tabular grain emulsions has been discovered. The process is applicable to both single-jet and double-jet precipitation techniques. The process can be identical to conventional single-jet and double-jet techniques for preparing high chloride emulsions, except that the dispersing medium in which the high chloride grains are nucleated and grown is controlled in a novel manner to (a) favor the formation of {111} crystal faces during nucleation, (b) incorporate into the grains parallel twin planes, essential for tabularity, into the grains, and (c) control the growth of the tabular grains so that the emergence of parallel {111} major crystal faces is favored.

In a preferred form of the invention the high chloride tabular grain emulsions are prepared by performing the step of grain nucleation under conditions that both (a) lead to the formation of {111} crystal faces and (b) introduce parallel twin planes into the grains as they are being formed.

It has been discovered that the formation of {111} crystal faces during grain nucleation can be realized by incorporating thiocyanate ion in the dispersing medium of the reaction vessel prior to introducing silver ion i.e., the silver salt solution, typically silver nitrate, which is introduced through the silver jet in both single jet and double jet precipitation techniques. Investigations have revealed that there is only a limited range of concentrations in which the thiocyanate ions are effective to produce {111} crystal faces. Thiocyanate ion concentrations in the range of from 2 to 30 millimoles per liter in the dispersing medium prior to introducing silver ion are contemplated. An optimum thiocyanate ion concentration for this purpose is in the range of from 2 to 20 millimoles per liter of the dispersing medium prior to introducing silver ion.

The thiocyanate ion can be introduced into the dispersing medium as an alkali metal (e.g., lithium, sodium or potassium). alkaline earth metal (e.g., magnesium, calcium or barium), or ammonium thiocyanate salt. The presence of an ammonium counter ion in the dispersing medium does not give rise to ammonia ripening effects, since this occurs only under basic conditions, whereas emulsion precipitations, except where an ammonia ripening effect is specifically sought, are conducted under acid conditions i.e, at a pH of less than 7.0, typically in the range of from about 2.0 to 6.0. A strong mineral acid, such as nitric acid, is conventionally employed to adjust pH. Ammonia ripening is preferably avoided, since this has been demonstrated to thicken the tabular grains, reducing their tabularity.

To introduce parallel twin planes in the high chloride grain nuclei as they are being formed, it is contemplated to adjust the chloride ion concentration in the dispersing medium prior to the introduction of silver ion to a concentration of at least 0.5 molar. For the high level of chloride ion to be effective for inducing twinning it is essential that thiocyanate ion also be present in the dispersing medium. The chloride ion in the reaction vessel can range upwardly to the saturation level of the soluble salt used to supply the chloride ion. In practice it is preferred to maintain the chloride ion concentration below saturation levels to avoid any tendency toward peptizer precipitation and elevated levels of viscosity of the aqueous solution in the reaction vessel. Preferred chloride ion concentration levels are in the range of from 0.5 to 4.0 molar, optimally from about 0.5 to 2.5 molar. The counter ion selection for the chloride ion present in the reaction vessel dispersing medium prior to silver ion introduction can be from the same group of counter ions noted above for the thiocyanate ions.

It is possible, but not preferred, to delay twinning until after nucleation has occurred. In this circumstance, a higher concentration of chloride ion than that of thiocyanate ion is maintained in the dispersing medium to avoid the formation of silver thiocyanate grains; however, the concentration of the chloride ion can be well below 0.5M. After grain nuclei are formed, the chloride ion concentration is then raised to at least 0.5M and preferably into the ranges indicated above. Although twinning can be deferred until after nucleation, the delay in twinning is preferably minimized. To avoid degradation of tabularity twinning should be initiated before 2 percent and, optimally, before 0.2 percent, of the silver ion has been introduced into the dispersing medium.

By placing sufficient chloride ion initially in the reaction vessel to react with silver ion introduced while still maintaining the concentration of chloride ion in the reaction vessel above 0.5 molar, it is possible to prepare tabular grain high chloride emulsions according to this invention without the further addition of halide ion. That is, high aspect ratio tabular grain silver chloride emulsions according to this invention can be prepared by single jet precipitation merely by introducing a conventional water soluble silver salt, such as silver nitrate.

It is, of course, possible to introduce additional chloride ion into the reaction vessel as precipitation progresses. This has the advantage of allowing the chloride concentration level of the reaction vessel to be maintained at or near an optimum molar concentration level. Thus, double-jet precipitation of tabular grain high chloride emulsions is contemplated. Conventional aqueous chloride salt solutions containing counter ions as identified above can be employed for the chloride ion jet.

Since silver bromide and silver iodide are markedly less soluble than silver chloride, it is appreciated that bromide and/or iodide ions, if introduced into the reaction vessel, are incorporated into the grains in the presence to the chloride ions. The inclusion of bromide ions in even small amounts has been observed to improve the tabularities of the emulsions. Bromide ion concentrations of up to 50 mole percent, based on total silver are contemplated, but to increase the advantages of high chloride concentrations it is preferred to limit the presence of other halides so that chloride accounts for at least 80 mole percent, based on silver, of the completed emulsion. Iodide can be also incorporated into the grains as they are being formed. It is preferred to limit iodide concentrations to 1 mole percent or less based on total silver. Thus, the process of the invention is capable of producing high chloride tabular grain emulsions in which the tabular grains consist essentially of silver chloride, silver chlorobromide, silver chloroiodide or silver chlorobromoiodide.

Grain nucleation occurs instantaneously following the addition of silver ion to the dispersing medium. While sustained or periodic subsequent nucleation is possible, to avoid polydispersity and reduction of tabularity, once a stable grain population has been produced in the reaction vessel, it is preferred to precipitate additional silver halide onto the existing grain population. In other words, it is preferred to complete nucleation at the outset of precipitation and then to proceed to grain growth.

The tabularity advantages resulting from even ideal nucleation conditions can be dissipated unless the growth of the tabular grain high chloride grains is controlled to favor preferential deposition of additional silver halide at the grain edges where the parallel twin planes emerge—i.e., the grain faces other than those forming the parallel {111} major crystal faces of the tabular grains. This is accomplished by maintaining a concentration of thiocyanate ions in the dispersing medium in the range of from 0.2 to 10 mole percent, optimally 1.5 to 5.0 mole percent, based on total silver introduced. The total silver referred to is not the instantaneous concentration of the silver in the reaction vessel, but the total silver introduced during the nucleation and growth steps.

In preparing high chloride tabular grain emulsions it has been observed that if the thiocyanate ion concentration is either above or below the limits indicated {100} crystal faces emerge. This is incompatible with achieving high levels of tabularity and the grains can, in fact, revert back to a nontabular cubic form.

The mechanism by which the thiocyanate ion controls the emergence of {111} crystal faces has not been proven. Emulsions containing silver thiocyanate grains are known. It is believed that thiocyanate ions must be at least adsorbed to the grain surfaces if not incorporated into the crystal lattice structure of the grains to be effective in producing the desired crystal faces. Emulsions prepared according to the process of the invention have not exhibited detectable levels of silver thiocyanate incorporated within the high chloride tabular grain population. A possible explanation is that chloride ions, because of their much smaller size, are preferentially incorporated into the crystal lattice, and the thiocyanate ions therefore remain at the grain surface as growth progresses, keeping their incorporated concentration levels undetectably low.

Since the thiocyanate ion is not appreciably incorporated in the tabular grains as they are being formed, the amount of thiocyanate ion in the dispersing medium at nucleation of the tabular grains can be sufficient to satisfy growth concentrations. It is also possible to introduce additional thiocyanate ion during growth, depending upon concentration levels sought to be maintained. All or any part of the thiocyanate and halide ions introduced concurrently with or following initial silver introduction into the dispersing medium can be in the form of a Lippmann emulsion—that is, a fine (<0.05 μm) grain dispersion of silver halide and/or silver thiocyanate.

A very significant advantage of the present invention is that thiocyanate ions known to be compatible with and in many instances synergistically interactive with a very wide range of sensitizers and adsorbed addenda present in conventional emulsions of the highest photographic efficiencies. By contrast, conventional high chloride tabular grain modifiers tend to restrict photographic utilities.

Another important practical advantage of the process of the invention is that any conventional photographic peptizer known to be compatible with forming silver bromide, iodobromide or high chloride tabular grain emulsions can be employed. In other words, the oxidized gelatino peptizer peptizers of Maskasky U.S. Pat. No. 4,713,323, the disclosure of which is here incorporated by reference, and even the synthetic polymer peptizers of Maskasky U.S. Pat. No. 4,400,463, the disclosure of which is here incorporated by reference, can be employed; however, a broader choice of peptizers are possible, including but not limited to those disclosed by *Research Disclosure,* Vol. 225, Jan. 1983, Item 22534, and *Research Disclosure,* Vol. 308, Dec. 1989, Item 308,119. *Research Disclosure.* is published by Kenneth Mason Publications, Ltd., Dudley Annex, 21*a* North Street, Emsworth, Hampshire P010 7DQ, England. In the process of the present invention gelatino peptizers which have not been treated with an oxidizing agent—i.e., those having methionine concentrations greater than 30 micromoles per gram—have been found just as effective as oxidized gelatino peptizers.

The processes of this invention are in all instances capable of producing high chloride tubular grain emulsions exhibiting tabularities ($D/t^2$, as defined above) of greater than 20. Tabularities of 100 or more are attainable, with tabularities in the range of from 30 to 50 being typical.

Except for the distinguishing features discussed above, precipitation according to the invention can take any convenient conventional form, such as disclosed in Research Disclosure Items 22534 and 308,119 (particularly Section I), Maskasky U.S. Pat. No. 4,400,463; Wey et al U.S. Pat. No. 4,414,306; and Maskasky U.S. Pat. No. 4,713,323; the disclosures of which are here incorporated by reference. It is typical practice to incorporate from about 20 to 80 percent of the total dispersing medium into the reaction vessel prior to nucleation. At the very outset of nucleation a peptizer is not essential, but it is usually most convenient and practical to place peptizer in the reaction vessel prior to nucleation. Peptizer concentrations of from about 0.2 to 10 (preferably 0.2 to 6) percent, based on the total weight of the contents of the reaction vessel are typical, with additional peptizer and other vehicles typically be added to emulsions after they are prepared to facilitate coating.

The processes of the invention are in all instances capable of producing high chloride tabular grain emulsions in which the tabular grains account for greater than 35 percent of the total grain projected area. Typically the tabular grains account for more than 50 percent of the total grain projected area.

Once the nucleation and growth steps have been performed the emulsions can be applied to photographic applications following conventional practices. The emulsions can be used as formed or further modified or blended to satisfy particular photographic aims. It is possible, for example, to practice the process of this invention and then to continue grain growth under conditions that degrade the tabularity of the grains and/or alter their halide content. It is also common practice to blend emulsions once formed with emulsions having differing grain compositions, grain shapes and/or grain tabularities.

EXAMPLES

The invention can be better appreciated by reference to the following examples.

EXAMPLE 1

Octahedral Grain AgCl Emulsions

This example illustrates that thiocyanate can serve as a growth modifier for AgCl to make octahedral grains and these grains will produce a photographic response.

To a stirred reaction vessel containing deionized bone gelatin (5 g) and distilled water (345 g) at 40° C. and adjusted to pH 2.0 with $HNO_3$ and to pAg 8.0 with NaCl was added $AgNO_3$ (4M) at a constant flow rate during 8 min and NaCl (4.57M) at a rate needed to maintain pAg 8.0 consuming 1.8% of the total silver. After 8 min, the NaCl solution was changed to one consisting of NaCl (4.42M) and varying doping levels of NaSCN, and the rate of silver addition was linearly accelerated over an additional period of 28 min (30 X from start to finish) during which time the remaining silver was added. The salt flow increased as necessary to maintain pAg 8.0. The precipitation was stopped after 0.6M of $AgNO_3$ was added.

The resulting emulsion was centrifuged free of soluble salts and resuspended in 200 ml of 3.7% deionized bone gelatin. The pAg was adjusted to 7.5 with NaCl.

As the NaSCN concentration was varied from 0 to 1.00 mole % of the total silver salts precipitated, ≈0.6 pm ECD silver chloride grains resulted having the crystal shapes listed below. At 0.35 mole % NaSCN, the emulsion consisted primarily of octahedra, as shown in FIG. 1.

| Mole % NaSCN | Crystal Shape |
|---|---|
| 0 | Cubes |
| 0.1 | Cubes |
| 0.25 | Rounded octahedra |
| 0.35 | Octahedra |
| 0.5 | Cubo-octahedra |
| 1.0 | Cubes |

From subsequent investigations corroborated by the Examples below it was determined that increasing the chloride ion concentration above 0.5M broadened the thiocyanate range within with {111} (octahedral) grain faces can be obtained.

Photographic Response

Coatings were made of the octahedral grained emulsion to contain 2.15 g/m$^2$ Ag, 3.6 g/m$^2$ gel. A coating was exposed for ½" through a graduated density step tablet. It was processed using Kodak Rapid X Ray Developer TM containing 0.5 g KI/L for 6 min at 20° C. The resulting image had a contrast of 1.74, a minimum density of 0.09, and a maximum density of 1.67.

EXAMPLE 2

Tabular AgCl Grain Emulsions

These examples illustrate the preparation of tabular AgCl grain emulsions.

EXAMPLE 2A

The reaction vessel, equipped with a stirrer, was charged with 4 g deionized bone gelatin, 0.45 mole $CaCl_2$, 7.37 mmoles NaSCN and distilled water to 545 g. The pH was adjusted to 5.6 at 55° C. At this temperature, a 2M $AgNO_3$ solution was added over a 30 sec period at a rate consuming 0.4% of the total Ag used. The addition was stopped for 2 min then resumed at the same addition rate for 1 min consuming 0.8% of the total Ag. The addition was then linearly accelerated over an additional period of 20 min (7.8 X from start to finish) during which time 70.4% of the total Ag was consumed. The flow rate was then held constant until the remaining 28.4% of the silver was added requiring 5 min. A total of 0.25M of AgCl was precipitated.

The resulting emulsion is shown in FIG. 2. It contained tabular grains having a mean diameter of 4 μm, a mean thickness of 0.4 μm, an average aspect ratio (D/t) of 10:1, and a mean tabularity (D/t$^2$) of 25. The tabular grain population consisted of 60% of the total projected area of the emulsion.

EXAMPLE 2B

This emulsion was prepared the same as that of Example 2A except that 6.10 mmoles NaSCN and low methionine gelatin were used, the pH was adjusted to 4.0 at 40° C., the precipitation temperature was 40° C. and there was no initial 30 sec $AgNO_3$ preaddition hold step.

A scanning electron photomicrograph of the resulting emulsion is shown in FIG. 3. The emulsion contained AgCl tabular grains of a mean diameter of 2.3μm, a mean thickness of 0.3μm, an average aspect ratio of 7.7:1, and a mean tabularity of 25.7. More than 50% of the total projected area of the emulsion consisted of tabular grains.

EXAMPLE 2C

This emulsion was prepared the same as that of Example 2A except that 6.10 mmole NaSCN was used and there was no initial 30 sec $AgNO_3$ preaddition hold step.

After 0.25 moles of AgCl had precipitated, the emulsion was poured into 6 L distilled water containing 15 g bone gelatin. It was allowed to gravity settle overnight and then the clear supernatant was discarded and the sludge was resuspended in 75 g of 4% bone gelatin solution. The pAg of this emulsion was adjusted to 7.5 at 40° C. with an NaCl solution.

The emulsion contained AgCl tabular grains of a mean diameter of 3.3μm, a mean thickness of 0.4μm, an average aspect ratio of 8.3, and a mean tabularity of 20.8. Fifty five percent of the total projected area of the emulsion consisted of tabular grains. X-ray powder diffraction pattern of the emulsion showed that the AgCl lattice was not expanded relative to pure AgCl indicating that the $SCN^-$ used as a growth modifier was not detectably incorporated into the lattice (<0.3 mole %).

EXAMPLE 3

Tabular Grain AgCl Emulsion Photographic Response

This example illustrates that the AgCl tabular grain emulsions made by this invention are capable of producing a photographic response.

Emulsion 2C was coated on estar support at 4.3 g/m$^2$ silver, 8.6 g/m$^2$ gelatin, and 5.2 mg/m$^2$ 1-(3-acetamidophenyl)-5-mercaptotetrazole.

The resulting coating was exposed for 1 sec through a graduated density step tablet, developed for 5 min in KODAK Developer stopped, fixed, and washed. The resulting image contained 0.54 g/m$^2$ developed silver in the area of minimum exposure (fog) and 3.9 g/m$^2$ silver in the area of maximum exposure.

EXAMPLE 4

Tabular AgBrCl Grain Emulsion

This example illustrates the preparation of a tabular grain emulsion consisting of 40 mole % Br, AgBrCl tabular grains.

To a stirred reaction vessel containing 4.0g deionized bone gelatin, 0.2 mole $CaCl_2$, 0.003 mole NaSCN and distilled water to a total weight of 400 g were added a solution 2M in $AgNO_3$ at 0.5 ml/min and a solution 1.6M in $CaCl_2$, 0.8M in NaBr and 0.015M in NaSCN at a rate needed to maintain a chloride ion concentration in the reaction vessel at 1M. After one minute, the rate of silver addition was linearly accelerated to 7.3 ml/min in 30 min. The total silver consumed was 0.25 moles and the volume of halide solution used was equal to that of the silver solution.

The resulting AgBrCl (40 mole % Br) emulsion contained tabular grains which accounted for 70% of the total projected area of the emulsion grains. These tabular grains had an average diameter of 3.7 μm and an average thickness of 0.23 μm, thus exhibiting an average aspect ratio of 16.1 and a mean tabularity of 70.

EXAMPLE 5

Control AgBrCl Emulsion

This example shows that thiocyanate is necessary for the formation of predominately AgCl tabular grains.

An AgBrCl emulsion was made similar to that of Example 4 except no NaSCN was added to the reaction vessel or to the halide solution.

The resulting AgBrCl (40 mole % Br) emulsion consisted of non tabular grains having an average diameter of 1.0 μm. Tabular grains were not present.

EXAMPLE 6

Effect of Time of Addition of Thiocyanate

These examples demonstrate the effect of adding thiocyanate (1.2 mole %) at different stages of the precipitation of the AgBrCl (40 mole % Br) emulsion: Example 6A before the start of precipitation, Example 6B after nucleation, Example 6C with the introduction of the salt solution. Only Example 6A produced a tabular grain emulsion.

EXAMPLE 6A

This emulsion was prepared similarly to the emulsion of Example 4, except that 0.003 mole NaSCN was added to the reaction vessel prior to silver salt introduction and no additional NaSCN was added during the precipitation.

The resulting AgBrCl (40 mole % Br) emulsion contained tabular grains making up 65% of the total grain projected area. The tabular grains had an ECD of 3.6 μm and an average thickness of 0.24 pm, providing an average aspect ratio of 15 and a mean tabularity of 62.5.

EXAMPLE 6B

This example was prepared similarly as Example 6A, except that no NaSCN was in the reaction vessel at the start of the precipitation, and 0.003 mole NaSCN was added after 2% of the $AgNO_3$ had been added to the reaction vessel.

The emulsion contained some tabular grains, but not enough to be considered a tabular grain emulsion. Tabular grains made up only 10% of the total grain projected area.

EXAMPLE 6C

This emulsion was prepared similarly as Example 6A, except that no NaSCN was in the reaction vessel at the start of the precipitation, the halide ion salt solution was made 0.024M in NaSCN so that by the end of the precipitation, 0.003 mole of NaSCN was added to the reaction vessel.

The emulsion contained some tabular grains, but not enough to be considered a tabular grain emulsion. Tabular grains made up only 20% of the total grain projected area.

The invention has been described in detail with particular reference to preferred embodiments thereof, but it will be understood that variations and modifications can be effected within the spirit and scope of the invention.

What is claimed is:

1. A process of preparing a photographic emulsion comprised of a dispersing medium and radiation sensitive silver halide grains wherein at least 35 percent of the total grain projected area is accounted for by tabular grains having parallel {111} major crystal faces and containing at least 50 mole percent chloride, based on total silver, said emulsion being prepared by introducing silver ion into a dispersing medium containing chloride ion,

CHARACTERIZED IN THAT grain nucleation is controlled to favor the formation of {111} crystal faces by providing thiocyanate ions in a concentration range of from 2 to 30 millimoles per liter in the dispersing medium prior to introducing silver ion, parallel twin planes are introduced in the grains by maintaining in the presence of thiocyanate ions a chloride ion concentration of at least 0.5 molar in the dispersing medium, and grain growth is controlled to favor the formation of the tabular grains having parallel {111} major crystal faces by maintaining a concentration of thiocyanate ions in the dispersing medium in the range of from 0.2 to 10 mole percent, based on total silver introduced.

2. A process according to claim 1 further characterized in that the radiation sensitive silver halide grains contain at least 80 percent chloride.

3. A process according to claim 2 further characterized in that the halide ions in the radiation sensitive silver halide grains consist essentially of silver chloride.

4. A process according to any one of claims 1, 2 or 3 further characterized in that the dispersing medium contains a 0.5 to 4.0 molar concentration of chloride ion.

5. A process according to claim 4 further characterized in that the dispersing medium contains a 0.5 to 2.5 molar concentration of chloride ion.

6. A process according to claim 1, 2 or 3 further characterized in that halide ion is added to the dispersing medium concurrently with the silver ion.

7. A process according to claim 6 further characterized in that chloride ion is added to the dispersing medium concurrently with the silver ion.

8. A process according to claim 1 or 2 further characterized in that bromide ion is added to dispersing medium concurrently with the silver ion.

9. A process according to claim 1 or 2 further characterized in that iodide ion is added to the dispersing medium concurrently with the silver ion.

10. A process according to claim 1 or 2 further characterized in that iodide ion is incorporated in the emulsion in a concentration of less 1 mole percent, based on total silver.

11. A process according to claim 1, 2 or 3 further characterized in that the concentration of thiocyanate ions in the dispersing medium is in the range of from 5 to 20 millimoles per liter prior to introducing the silver ion.

12. A process according to claim 1, 2 or 3 further characterized in that grain growth is controlled to favor the formation of the tabular grains having parallel {111} major crystal faces by maintaining a concentration of thiocyanate ions in the dispersing medium in the range of from 1.5 to 5 mole percent, based on total silver introduced.

13. A process according to claim 1, 2 or 3 further characterized in that the tabular grains account for greater than 50 percent of the total grain projected area.

14. A process according to claim 1, 2 or 3 further characterized in that the tabular grains exhibit a tabularity of greater than 20.

15. A process according to claim 14 further characterized in that the tabular grains exhibit a tabularity in the range of from greater than 25 to 100.

16. A process according to claim 15 further characterized in that the tabular grains exhibit a tabularity in the range of from 30 to 50.

17. A process according to claim 1, 2 or 3 further characterized in that the dispersing medium contains a gelatino peptizer.

* * * * *